United States Patent [19]

Boenigk et al.

[11] Patent Number: 4,943,365

[45] Date of Patent: Jul. 24, 1990

[54] METHOD FOR THE PRODUCTION OF MODIFIED PITCHES AND THE FURTHER APPLICATION

[75] Inventors: Winfried Boenigk, Olfen; Maximilian Zander, Castrop-Rauxel; Jürgen Stadelhofer, Bad Soden, all of Fed. Rep. of Germany

[73] Assignee: Rütgerswerke AG, Frankfurt am Main, Fed. Rep. of Germany

[21] Appl. No.: 23,646

[22] Filed: Mar. 9, 1987

[30] Foreign Application Priority Data

Mar. 12, 1986 [DE] Fed. Rep. of Germany ..... 3608130

[51] Int. Cl.[5] ..... G10C 1/20

[52] U.S. Cl. ..... 208/44; 208/22; 208/39; 423/445; 423/447.1; 423/447.2

[58] Field of Search ..... 208/44, 39, 22

[56] References Cited

U.S. PATENT DOCUMENTS

| | | | |
|---|---|---|---|
| 4,021,356 | 5/1977 | Kudchadker et al. | 208/44 |
| 4,399,024 | 8/1983 | Fukui et al. | 208/44 |
| 4,431,513 | 2/1984 | Lewis | 208/44 |
| 4,457,828 | 7/1984 | Lewis | 208/22 |
| 4,465,585 | 8/1984 | Lewis | 208/22 |
| 4,469,585 | 9/1984 | Cukier | 208/44 |

FOREIGN PATENT DOCUMENTS

| | | | |
|---|---|---|---|
| 891474 | 1/1972 | Canada | 208/44 |
| 27739 | 4/1981 | European Pat. Off. | 208/44 |
| 72242 | 2/1983 | European Pat. Off. | 208/44 |
| 117383 | 9/1984 | European Pat. Off. | 208/44 |
| 70419 | 6/1975 | Japan | 208/44 |
| 105715 | 8/1975 | Japan | 208/44 |
| 124622 | 2/1976 | Japan | 208/44 |
| 147586 | 9/1982 | Japan | 208/44 |
| 992560 | 1/1983 | U.S.S.R. | 208/44 |
| 1022985 | 4/1983 | U.S.S.R. | 208/39 |
| 899598 | 6/1962 | United Kingdom | 208/44 |

*Primary Examiner*—H. M. S.g17 Sneed
*Assistant Examiner*—Helane Myers
*Attorney, Agent, or Firm*—Horst M. Kasper

[57] ABSTRACT

Contrary to known alkylation of pitches, it is disclosed that pitches are modified with particular aromatically substituted and activated $C_1$ to $C_4$ alkyl groups. The resulting modified pitches are easily polycondensed and give high coking residues and good mesophase formation. This is achieved on the one hand by dispensing with catalysts, which can be only incompletely removed from the pitch and, on the other hand, by employing reactive short chain alkyl aromatic compounds.

16 Claims, No Drawings

METHOD FOR THE PRODUCTION OF MODIFIED PITCHES AND THE FURTHER APPLICATION

BACKGROUND OF THE INVENTION

1. Field of the Invention

The invention relates to a method for production of pitches with modified properties, and to the use of these pitches.

2. Brief Description of the Background of the Invention Including Prior Art

The use of pitches and of pitch-like residue from the upgrading of coal and from the processing of mineral oils is extremely varied. In addition to their use in construction as binders, corrosion protection agents, setting agents and insulating agents, their use is of particular interest in connection with carbon or, respectively, carbon-mold bodies. There have been numerous attempts to modify the pitches in order to improve the desired properties, since the properties of the available pitches do not always correspond to the requirements, necessities and desires of further processing operations. The coking properties of pitches can be modified by the separating of undesired components such as, for example, ash forming materials, and of fractions that are insoluble in quinoline. Furthermore, a modification by thermal treatment and hydrogenation has been described.

Hydrogenation is the most expensive and costly method in terms of equipment and processing requirements. The influence of the alkylation of benzene insoluble (BI)/quinoline soluble (QS) ($\beta$-resins) and of quinoline insoluble fraction (QI) from coal tar pitch has also been investigated (Fuel 1974, 53(4), 253–7). For example, the alkylation with alkyl halides improves the solubility in benzene. However, in contrast to the results from hydrogenation, no improvement of the graphitizing properties and of the coke structure is seen. Similar investigations with quinoline insoluble fractions of petroleum pitches have been performed (Fuel 1975, 54(4), 265–8). During the alkylation with potassium and ethyl iodide, 60% of the pitch can be transformed into a benzene soluble material. The coking properties, however, are not improved. The alkylated pitch is again dealkylated by catalytic hydration.

Material that is soluble but has bad graphitizing properties is obtained by the akylation of asphalt with dodecylchloride with a Friedel-Crafts reaction (Nenryo Kyokai-Shi 1975, 54(12), 994–1001). The quality improvement of petroleum and coal tar pitch by alkylation of a sodium containing pitch/solvent mixture with ethyl iodide followed by catalytic hydrogenation is described in the Japanese Patent No. 7641,129. Quinoline insoluble fractions (30 weight percent quinoline insoluble (QI)) can be brought into solution by this treatment in an amount of up to 86 weight percent. The needle coke or acicular coke can be produced from the pitch free if quinoline insoluble content in a yield of 96 weight percent. The improved coking properties are to be assigned to the separation of the quinoline insoluble portion and to the hydrogenation, since the alkylation with ethyl iodide in the presence of sodium by itself does not result in an improvement in the coking behavior, as was set forth above.

In fact, the alkylation by a Friedel-Crafts reaction improves the solubility even of pitch fraction insoluble in quinoline. However, the coking behavior is not improved (Sekioyu Gakkai-Shi 1978, 21(1), 16–21). The coking properties become clearly worse. Even the starting pitch material can be coked to an anisotropic coke, but a non-graphitizable coke is obtained from the alkylated pitch.

SUMMARY OF THE INVENTION

1. Purposes of the Invention

It is an object of the present invention to produces pitches by alkylation that are particularly suitable for the production of carbon mold bodies and of their precursors.

It is another object of the present invention to furnish pitches that are not already de-alkylated before the start of polycondensation.

It is yet another object of the present invention to provide pitches that are particularly suited for graphitization, for the formation of needle coke and as binders for graphite electrodes.

These and other objects and advantages of the present invention will become evident from the description which follows.

2. Brief Description of the Invention

The present invention provides a method for alkylation of pitches comprising mixing 100 weight parts of a pitch with from about 5 to 50 weight parts of a reactive alkyl compound having from 1 to 4 carbon atoms, where at least one hydrogen atom of the alkyl is substituted by an aromatic substituent and where an active section is present at the alkyl. The pitch is alkylated with the reactive alkyl compound in a liquid phase.

Preferably, the pitch is alkylated under homogenous pressure of the alkylation reagent. Solvents can be added to lower the softening point of the pitch during the alkylation step. The presence of catalysts is not always required. If catalysts are needed to promote alkylation, only gaseous catalysts like hydrogen chloride gas are used. Alkylation of course implies the presence of an alkylating reagent.

A multiple bond can be employed to provide an active section to the alkyl. A reactive substituent can be substituted for a hydrogen of the alkyl to provide an active section to the alkyl. The reactive substituent for hydrogen can be a member of the group consisting of halogen, hydroxy, epoxy, thiol and mixtures thereof.

A pitch that is an aromatic mineral oil residue having a softening point according to the Kraemer-Sarnow method of between from about 40 to 150 degrees centigrade can be employed.

Alternatively, a pitch that is an aromatic coal derived residue having a softening point according to the Kraemer-Sarnow method of between from about 40 to 150 degrees centigrade can be used.

The reactive alkyl compount can be employed in an amount of from 10 to 30 weight parts.

The softening point of the alkylated pitch can be risen by ordinary distillation.

The alkylated pitch can be fluxed with high boiling point aromatic oils as an impregnating agent for carbon mold bodies. High boiling point aromatic oils include aromatic oils having a boiling point above 200° C. and preferably above 300° C. Such high boiling point aromatic oils include anthracene (b.p. 340° C.) and pyrene (b.p. 394° C.)

The alkylated pitch can be thermally polycondensed to from a precursor for a production of a highly anisotropic coke. The thermal polycondensation can occur at temperatures from 300° to 500° C.

The pitch can be thermally treated in a vacuum for obtaining a pitch with a softening point according to Kraemer-Sarnow of from about 200 to 350 degrees centigrade, having a quinoline-insoluble content of from about 15 to 50 weight percent and a mesophase content of up to 100 percent for providing a precursor for carbon fibers. The thermal treatment can be at temperatures from 300° to 500° C. for times over 1 minute and under pressures from 10 millibar up to 600 millibar.

The alkylated pitch can be mixed with carbon for binding the carbon to form an electrode, which is baked at temperatures up to 1400° C.

Another aspect of the present invention provides an alkylated pitch obtained by mixing 100 weight parts of a pitch with from about 5 to 50 weight parts of a reactive alkyl compound having from 1 to 4 carbon atoms, where at least one hydrogen atom of the alkyl is substituted by an aromatic substituent and where an active section is present at the alkyl and alkylating the pitch with the alkyl compound in a liquid phase.

The novel features which are considered as characteristic for the invention are set forth in the appended claims. The invention itself, however, both as to its construction and its method of operation, together with additional objects and advantages thereof, will be best understood from the following description of specific embodiments.

DESCRIPTION OF INVENTION AND PREFERRED EMBODIMENT

In accordance with the present invention, there is provided a method for alkylating of pitches, where the pitches are alkylated with 5 to 50 weight percent relative to the pitch of a reactive $C_1$- to $C_4$- alkyl compound, preferably a $C_1$- to $C_2$- alkyl compound which comprises at least one aromatic substituent and at least a multiple bond and/or a reactive substituent, in a liquid phase and possibly under pressure, possibly under addition of solvents and/or of gaseous catalysts.

The aromatic substituent can include phenyl, toluyl, xylyl, indenyl, naphthalyl, alpha-methylnaphthyl, methylnaphthyl, diphenyl, acenaphthyl, phenanthryl, anthracenyl, fluorenthenyl, pyrenyl, chrysenyl, mesitylyl, butylbenzyl, pseudocumyl, prehnityl, isoduryl, pentamethylbenzyl, ethylbenzyl, n-propylbenzyl, p-cumyl, triethylbenzyl, styryl, benzylphenyl, tolyphenyl, diphenyl, terphenyl. The aromatic substituent itself may have a second reactive side chain. Preferred aromatic compounds contain up to 4 aromatic rings and less than 20 carbon atoms and preferably less than 10 carbon atoms.

The reactive substituents can comprise hydroxy groups, mercapto groups, epoxy groups, thiol groups, halogen groups, double bond, and/or methoxy groups. A multiple bond can occur in chains having at least two carbon atoms. The reaction is to occur in a liquid phase, which can be achieved by heating the mixture and/or by the addition of a solvent.

The pressure of the reaction can be less than 1000 bar and is preferably less than 100 bar. The reaction temperature is preferably from 100 to 400 degrees Centigrade and preferably between 150 and 300 degrees Centigrade. The solvents employed are preferably inert aromatic solvents such as benzene, toluene and mixtures of coal tar oils.

The gaseous catalysts employed include hydrogen chloride, hydrogen bromide, hydrogen fluoride and borontrifluorid. Suitable catalysts exhibit a high protonic activity.

The pitch can be an aromatic mineral oil or carbon derived residue with a softening point in the region of from about 40 to 150 degrees Centigrade according to the Kraemer-Sarnow scale. The reactive alkyl group can be added to the pitch is an amount of from 5 to 50 weight percent and preferably in an amount of 10 to 30 weight percent referring to an amount of 100% pitch. The catalyst is preferably hydrogen chloride gas.

The alkylated pitch can be further processed by distilling off components with low boiling points. Components with low boiling points are components which boil at a temperature below 150 degrees Centigrade at atmospheric pressure and preferably below 110 degrees Centigrade at atmospheric pressure. Alternatively, the alkylated pitch can be fluxed with high boiling aromatic oils as impregnating means for carbon mold bodies. High boiling aromatic oils are considered to be aromatic oils that have a boiling point above 200 degrees Centigrade and preferably above 300 degrees Centigrade. Impregnating means are means that are suitable for soaking electrodes and for enhancing the mechanical stability of eletrodes in particular upon thermal treatments.

The alkylated pitch can employed after thermal polycondensation, as a precursor for the production of highly anisotropic coke. Polycondensation in the context of the present invention means that organic compounds are condensed to long chain or disk like molecules under elimination of hydrogen. The alkylated pitch can further be thermally treated in vacuum such that there results a material with a softening point according to Kraemer-Sarnow at from about 200° to 350° C., a quinoline insoluble content of from 15 to 50 weight percent, and a mesophase of up to 100 weight percent. Such material is suitable as a precursor for fabrication of carbon fibers.

Furthermore, the pitch can be separated from easily boiled compounds or can be fluxed with high boiling aromatic oils and can then be used as a binder in the production of electrodes, in particular, of graphite electrodes.

In accordance with the invention, a pitch is alkylated with 5 to 50 weight percent as referred to the amount of pitch of a reactive $C_1$ to $C_4$ alkyl compound. The alkyl compound includes at least an aromatic substituent and at least a multiple bond and/or a reactive substituent. The alkylation is performed in a liquid phase, possibly under pressure, possibly under addition of solvent and/or of gaseous catalysts.

All mineral oil or carbon derived aromatic residues having a high boiling point can be used as a pitch. These residues can have a softening point according to Kraemer-Sarnow of from about 40° to 150° C. and include for example, aromatic extracts from bituminous residues, destructive distillation products of organic matter, aromatic hydrocarbon extract, bituminous coal pitches, carbon oils, cracking residues, coal oils, crude oils obtained by destructive distillation of bituminous coal and the like. Preferred pitches are those that are free of solid residues.

In addition to halogens, also hydroxy groups, oxy groups, and thiol groups are to be considered as reactive substituent of the alkylating agent.

Alternatingly, part of the hydroxy compounds have to be substituted by corresponding halogen compounds in order to avoid the addition of further catalysts. The catalyst—if added—however, cannot remain in the alkylated pitch, since it accelerates a de-alkylation during further processing by a thermal treatment. Solid catalyst such as, for example, aluminium chloride, are unsuitable for this purpose. Therefore, the present invention contemplates employing only gaseous catalysts such as hydrogen chloride or catalysts that can easily be completely removed after the reaction has been performed.

Solvents are not required in the context of the invention, but they can be employed in particular where it is desirable to use alkylating temperatures below 30 degrees Centigrades above the melting point of the pitch in order to lower the viscosity of the pitch. The alkylating agent is added preferably above the softening point of the pitch and in particular at temperatures from about 30 to 100 degrees Centigrade above the softening point of the above the softening point of the pitch, more preferably at temperatures between 50 and 80 degrees Centigrade above the softening point of the pitch such as in particular at a temperature of 60 degrees Centigrade above the softening point of the pitch. At temperatures above the boiling point of the alkylating agent, the alkylation is performed under pressure, which pressure corresponds to the vapour pressure of the alkylating agent. In such a case, the alkylation can be performed in a closed system retort. The reaction time depends on the temperature and on the alkylating agend employed, which alkylating agent can be used in an amount of from about 5 to 50 weight percent and preferably in an amount of 10 to 30 weight percent as referred to the total amount of pitch. The pitch alkylated according to the invention, similarly to conventional alkylated pitches, in general exhibits a reduced viscosity and a reduced content of toluene insoluble (TI) and quinoline /QI) material as compared with the starting pitch. In contrast to the known alkylating pitches however, the coke residue according to the Conradson method is increased and single phase mesophase pitch is formed during thermal treatment as is the case in hydrogenated pitches. A mesophase is a phase wherein the material exhibits pseudo-crystalline properties. This means that in the pitch according to the invention, there occurs no de-alkylation during thermal treatment, as it is described in all known literature about alkylated pitches. In the contrary the introduced aromatic alkyl groups catalyze polymerization reactions of the pitch and are changed in structure during polymerization.

The invention and the properties of the pitches obtained according to the invention method are illustrated in more detail in the following examples. The following examples serve to illustrate the practical performance of the invention but are to be considered to limit the extent of the invention.

EXAMPLE 1

100 weight parts of filtered coal tar standard pitch with a softening point (EP) according to Kraemer-Sarnow of 72° C., a coke according to Conradson of 44.6 weight percent, containing 23.2 weight percent of toluene insoluble material (TI), 0.3 weight percent quinoline insoluble material (QI) has the following elementary analysis:

| | |
|---|---|
| C | 92.6% |
| H | 4.7% |
| N | 1.3% |
| S | 0.6% |

This material is melted in a vessel provided with a stirrer and with a reflux condenser and heated to 160° C. Then 30 weight parts benzylchloride are added under stirring. The mixture is heated to 250° C. and this temperature is maintained for about 5 hours. The properties of the resulting alkylated pitch (1) are set forth in Table 1.

In order to characterize the properties of this pitch during thermal treatment, a sample of the pitch was heated under protective gas and under slow stirring at a pressure of 130 millibars up to 400° C., and this temperature was maintained. Upon reaching this temperature and every 30 minutes thereafter, a sample was removed in order to determine the softening point (EP) or, respectively, the flow point (FP) according to the melting determination of Dr. Tottoli, the toluene insoluble material (TI), the quinoline insoluble material (QI) and the coking residue. In addition the distillate material amount was measured as referred to the starting material. These results are recited in Table 1 where the sample taken upon reaching 400° C. is designated with (2) and all following samples are sequentially numbered.

TABLE 1

| | Pitch Sample | | | | |
|---|---|---|---|---|---|
| | 1 | 2 | 3 | 4 | 5 |
| Time of Sample Taking | cold | 400° C. | 30 min | 60 min | 90 min |
| FP (°C.) | — | 173 | 240 | 260 | 330 |
| EP (K.-S.) (°C.) | 78 | — | — | — | — |
| TI (weight %) | 19.5 | 50.8 | 63.0 | 67.0 | 76.5 |
| QI (weight %) | 0.15 | 3.2 | 22.3 | 29.3 | 44.3 |
| Coking Residue (Conradson) (weight %) | 46.1 | 67.7 | 77.0 | 80.1 | 82.7 |
| Distillate (weight %) | — | 16.0 | 21.2 | 22.8 | 24.0 |

The pitch sample 5 comprises a single phase mesophase pitch.

EXAMPLE 2

100 weight percent of a coal tar pitch with a softening point according to the Kraemer-Sarnow method of 90° C. was mixed at 180° C. with 10 weight percent of a mixture of 90 weight percent benzyl alcohol and 10 weight percent benzyl chloride and alkylated. Benzyl chloride can be substituted by benzyl alcohol if dry hydrogen chloride gas is passed through the liquid pitch during the reaction. The reaction mixture is heated to 250° C. and maintained at this temperature to the end of the water segregation. The analytic characteristic numbers of the pitch change by the benzylation as follows:

TABLE 2

| | Pitch before benzylation | Pitch after benzylation |
|---|---|---|
| EP (K.-S.) (°C.) | 90 | 96 |
| TI (weight %) | 32.6 | 32.8 |
| QI (weight %) | 8.5 | 7.9 |
| Coking Residue (Conradson) (weight %) | 56.3 | 59.4 |

EXAMPLE 3

30 weight parts chloromethylnaphthalene are slowly dripped into 100 weight parts of a petroleum pitch at 200° C. The temperature is increased over a time span of three hours to 250° C. and maintained for an additional three hours at 250° C. The analytic characteristic data of the starting material and of the pitch alkylated according to the invention are set forth in Table 3.

TABLE 3

| | Starting pitch | Alkylated petroleum pitch |
|---|---|---|
| EP (K.-S.) (°C.) | 99 | 111 |
| TI (weight %) | 3.2 | 8.5 |
| QI (weight %) | — | — |
| Coke residue (Conradson) (weight %) | 45.4 | 53.0 |
| C (weight %) | 93.5 | 93.8 |
| H (weight %) | 6.2 | 6.4 |

EXAMPLE 4

One hundred weight percent of a coal derived pitch with a softening point (EP) (according to Kraemer-Sarnow) of 41° C., a coking residue (according to Conradson) of 31.2 weight percent, 13.2 weight percent toluene insoluble (TI) and 3.5 weight percent quinoline insoluble (QI) was heated to 140° C. 20 weight percent styrene was added under stirring. After the addition of styrene, the temperature was slowly increased to 250° C. Three hours after reaching the final temperature, the easily volatized by-products were distilled off, and the softening point of the pitch was increased to 70° C. by thermal treatment. The pitch reacted with styrene exhibited the following properties: Softening point (EP) (according to Kraemer-Sarnow) 71° C.; TI 25.2 weight percent; QI 3.0 weight percent; coking residue (Conradson) 46.6 weight percent.

EXAMPLE 5 (COMPARISON)

Filtered standard pitch as described in Example 1 was thermally treated under the same conditions as described in Example 1. The material data are recited in Table 4. A phase separation into an isotropic pitch matrix (about 80 weight percent) and into an anisotropic bulk mesophase occurs after 60 minutes with a flow point that can no longer be determined after the separation. Therefore, in each case two values are indicated under the pitch sample 5. The first of the two values was measured with the pitch matrix and the second recited value was measured with the bulk mesophase.

TABLE 4

| | Pitch Sample | | | |
|---|---|---|---|---|
| | 2 | 3 | 4 | 5 |
| Time of Sample Taking | 400° C. | 30 min | 60 min | 90 min |
| FP (°C.) | — | — | — | 175/— |
| EP (K.-S.) (°C.) | 87 | 118 | 140 | —/— |
| TI (weight %) | 26.0 | 35.1 | 43.9 | 53.0/75.1.5 |
| QI (weight %) | 0.6 | 1.8 | 4.5 | 7.6/48.4 |
| Coking Residue (Conradson) (weight %) | 50.0 | 59.8 | 65.6 | 72.3/82.4 |
| Distillate (weight %) | 2.3 | 24.0 | 28.9 | 32.9 |

Comparison of the properties of the alkylated pitch in Example 1 with those of Example 5 demonstrates clearly that the polycondensation is accelerated by the alkylation according to the invention. This is seen from the faster rise in the toluene insoluble and the quinoline insoluble portions. In this context also lower boiling pitch compounds are bound in (the amount of distillate is smaller) and the coking residue is higher, which clearly indicates a high thermal stability of the alkylated pitch. In addition, during the thermal treatment of the alkylated pitch, no phase segregation is observed.

EXAMPLE 6 (COMPARISON)

A hundred weight parts corresponding to Example 1 are heated together with 300 weight parts of 1.2.3.4.tetrahydroquinoline to 430° C. under stirring and at a pressure of 25 bar in a stirrer autoclave. The temperature of 430° C. was maintained for 15 minutes. Hydrogenated pitch (1) with the properties recited in Table 5 was obtained after distilling off the solvent. A sample of this pitch was thermally treated in the way set forth in connection with Example 1. The analytical results are set forth in Table 5 and correspond to those of Table 1 of Example 1.

TABLE 5

| | Pitch Sample | | | | |
|---|---|---|---|---|---|
| | 1 | 2 | 3 | 4 | 5 |
| Time of Sample Taking | cold | 400° C. | 30 min | 60 min | 90 min |
| EP (K.-S.) (°C.) | 48 | 90 | 136 | 180 | 245 |
| TI (weight %) | 4.8 | 10.9 | 27.9 | 50.9 | 64.7 |
| QI (weight %) | 0.1 | 0.1 | 0.2 | 3.9 | 16.5 |
| Coking Residue (Conradson) (weight %) | 28.3 | 51.37 | 72.2 | 81.1 | 86.2 |
| Distillate (weight %) | — | 34.3 | 48.6 | 51.5 | 54.9 |

The pitch obtains a better solubility by hydrogenation as compared to alkylation, and a lower viscosity is obtained. The polymerization, however, is delayed as seen by the quinoline insoluble (QI) portion, and the amount in polymerizable content material is decreased as seen in the amount of distillate. The mesophase pitch is formed in a much smaller amount and also comprises a homogeneous phase as in the case of alkylated pitch.

EXAMPLE 7 (COMPARISON)

One hundred weight parts of benzene extract of a standard pitch corresponding to Example 1 is compounded with 3 weight parts of aluminum chloride $AlCl_3$. Then 31.3 weight parts of n-butylchloride dissolved in benzene are added drop by drop at 50° C. under stirring and the temperature is increased to 80° C. After a reaction time of 2 hours, the reaction product is washed to neutral, and the solvent is distilled off at 200° C. and 5 millibar pressure. The butylated pitch obtained as a residue is characterized by the values set forth in Table 6. The content in butyl is calculated from the C/H ratio as 7 weight percent. The coke residue is decreased substantially. This conclusion is based not only on the de-alkylation observed during the thermal treatment, the pitch itself has become thermally unstable. The thermal cracking is competing with the polymerization reaction, and no mesophases can be formed. This reasons for this can be found both in the easy cracking and splitting off of the butyl groups as well as in the almost total impossibility of completely removing the catalyst from the pitch solution.

TABLE 6

| | butylated pitch |
|---|---|
| EP (K.-S.) (°C.) | 44 |
| TI (weight %) | 11.2 |
| QI (weight %) | 0.4 |
| Coke residue (Conradson) (weight %) | 22.1 |

TABLE 6-continued

| | butylated pitch |
|---|---|
| C/H | 1.45 |

The advantageous properties of the alkylated pitches according to the invention, such as for example the high coking residue or, respectively, the low amount of distillate resulting, the higher reactivity and the ability to form homogeneous mesophase pitches, improve the application possibilities of the alkylated pitch as a precursor for the production of carbon mold bodies such as illustrated by way of the following examples.

EXAMPLE 8

An alkylated pitch obtained according to method of Example 2 was mixed with petroleum coke of defined granularity and was baked up to 960° C. to form test anodes according to conventional procedures in aluminium industry. The properties of the molded bodies were compared with test anodes from pitches of the same softening point. The test anodes of benzylated pitch exhibit the same mechanical and electrical properties and the same burning off properties at a baking time reduced by 20% of that of the test anodes made of ordinary pitch.

EXAMPLE 9

Petroleum pitch alkylated with chlormethylnaphthalene as produced according to Example 3 was investigated with an in situ heating table microscope in a nitrogen $N^2$gas flow. At temperatures from about 350° to 400° C., large mesophase domains are generated upon a heating speed of 3° C./min forming anisotropic coke upon further heating. Pitches with such behaviour are suitable as precursors for needle coke products.

EXAMPLE 10

The pitch alkylated with styrene as in Example 4 can be employed as an impregnating pitch. The effect of the alkylation becomes visible upon comparison with a conventionally produced impregnating pitch.

TABLE 7

| | comparison pitch | alkylated impregnation pitch |
|---|---|---|
| EP (K.-S.) (°C.) | 70 | 71 |
| TI (weight %) | 19.2 | 25.2 |
| QI (weight %) | 4.1 | 3.0 |
| Coke residue (Conradson) (weight %) | 43.2 | 46.6 |
| Viscosity at 140° C. (mPa s) | 800 | 500 |

The higher reactivity of the alkylated pitch upon thermal treatment can explain higher coking residues. The changed chemical structure at the same time effects a viscosity decrease that is important for applications.

EXAMPLE 11

One hundred weight parts of an alkylated pitch according to Example 1 were treated at 400° C. under a pressure of 100 millibars for 60 minutes in an autoclave under stirring in a nitrogen $N_2$ atmosphere to provide a thermal treatment. Homogeneous mesophase pitch is generated with a softening point according to Kraemer-Sarnow of 270° C., a mesophase content of 72 volume percent, and quinoline insoluble contents (QI) of 27.3 weight percent. Pitches of this kind are excellent as precursors for the production of carbon fibers.

Precursors for carbon fibers with a softening point according to Kraemer-Sarnow of between 200° and 350° C., with a quinoline insoluble contents of from 15 to 50 weight percent and a mesophase content of up to 100 weight percent can be produced in a simple way by varying the parameters of the thermal treatment and by varying the alkylating agent.

It will be understood that each of the processes described above, or two or more together, may also find a useful application in other types of pitch modification procedures and applications differing from the types described above.

While the invention has been illustrated and described as embodied in the context of a method for the production of modified pitches, and their further applications, it is not intended to be limited to the details shown, since various modifications and procedural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method for alkylation of pitches comprising mixing 100 weight parts of a hydrocarbon pitch with from about 5 to 50 weight parts of a reactive alkyl compound having from 1 to 4 carbon atoms, where at least one hydrogen atom of the alkyl is substituted by an aromatic substituent and where the alkyl groups is selected from a member of the group consisting of alkyl groups having a multiple bond between two carbon atoms, alkyl groups having a substituent for hydrogen of the alkyl which substituent is selected from a member of the group consisting of hydroxy, expoxy, thiol, and mixtures thereof, and mixtures thereof to provide an active section to the alkyl for facilitating alkylation;

alkylating the hydrocarbon pitch with the reactive alkyl compound in a liquid phase at a pressure of less than about 1000 bar and at a temperature of from about 100 to 400 degrees centigrade.

2. The method for alkylation of pitches according to claim 1 further comprising pressurizing pitch and alkyl compound during the alkylating step.

3. A method for alkylation of pitches comprising mixing 100 weight parts of a hydrocarbon pitch with from about 5 to 50 weight parts of a reactive alkyl compound having from 1 to 4 carbon atoms, where at least one hydrogen atom of the alkyl is substituted by an aromatic substituent and where an active section for facilitating alkylation is present at the alkyl;

alkylating the hydrocarbon pitch with the reactive alkyl compound in a liquid phase at a pressure of less than about 1000 bar and at a temperature of from about 100 to 400 degrees centigrade;

adding inert aromatic solvents to the pitch and alkyl compound during the alkylating step.

4. The method for alkylation of pitches according to claim 1 further comprising adding catalysts in a vaporized state to the pitch and alkyl compound for catalyzing the alkylating step.

5. A method for alkylation of pitches comprising mixing 100 weight parts of a hydrocarbon pitch with from about 5 to 50 weight parts of a reactive alkyl compound having from 1 to 4 carbon atoms, where at least one hydrogen atom of the alkyl is substituted by an aromatic substituent and where an active section for facilitating alkylation is present at the alkyl;

alkylating the hydrocarbon pitch with the reactive alkyl compound in a liquid phase at a pressure of less than about 1000 bar and at a temperature of from about 100 to 400 degrees centigrade;

adding hydrogen chloride as a catalyst in a vaporized state to the pitch and alkyl compound for catalyzing the alkylating step.

6. The method for alkylation of pitches according to claim 1 further comprising a reactive alkyl compound having a multiple bond between two carbon atoms on the alkyl to provide an active section to the alkyl.

7. The method for alkylation of pitches according to claim 1 further comprising a reactive alkyl compound having a reactive substituent to provide an active section to the alkyl.

8. The method for alkylation of pitches according to claim 1 further comprising employing a pitch which is an aromatic mineral oil residue having a softening point of between from about 40 to 150 degrees centigrade according to the Kraemer-Sarnow method as a starting material.

9. The method for alkylation of pitches according to claim 1 further comprising employing a pitch which is an aromatic coal derived residue having a softening point of between from about 40 to 150 degrees centigrade according to the Kraemer-Sarnow method as a starting material.

10. The method for alkylation of pitches according to claim 1 further comprising employing the reactive alkyl compound in an amount of from about 10 to 30 weight parts.

11. The method for alkylation of pitches according to claim 1 further comprising distilling off components having a low boiling point.

12. The method for alkylation of pitches according to claim 1 further comprising fluxing said alkylated pitch with high boiling point aromatic oils for forming an impregnating agent for carbon mold bodies.

13. The method for alkylation of pitches according to claim 1 further comprising thermally polycondensing the alkylated pitch to form a precursor for a production of a highly anisotropic coke.

14. The method for alkylation of pitches according to claim 1 further comprising thermally treating the alkylated pitch in a vacuum to obtain a pitch with a softening point of from about 200 to 350 degrees centigrade according to Kraemer-Sarnow, and having a quinoline-insoluble content of from about 15 to 50 weight percent and a mesophase content of up to 100 percent for providing a precursor for carbon fibers.

15. The method for alkylation of pitches according to claim 1 further comprising mixing the alkylated pitch with carbon for binding the carbon to form an electrode.

16. The method for alkylation of pitches according to claim 1 further comprising mixing the pitch with petroleum coke, baking the mixture at temperatures up to 1400 degrees centrigrade.

* * * * *